US007546659B2

(12) United States Patent
Tatsuzawa et al.

(10) Patent No.: US 7,546,659 B2
(45) Date of Patent: Jun. 16, 2009

(54) GOLF BALL CLEANER

(75) Inventors: Masahiko Tatsuzawa, Fuefuki (JP); Takenori Tatsuzawa, Fuefuki (JP)

(73) Assignee: Tatsuzawa Kasei Corporation, Yamanashi (JP)

( * ) Notice: Subject to any disclaimer, the term of this patent is extended or adjusted under 35 U.S.C. 154(b) by 0 days.

(21) Appl. No.: 11/628,008

(22) PCT Filed: May 31, 2004

(86) PCT No.: PCT/JP2004/007477

§ 371 (c)(1),
(2), (4) Date: Dec. 10, 2007

(87) PCT Pub. No.: WO2005/115562

PCT Pub. Date: Dec. 8, 2005

(65) Prior Publication Data

US 2008/0209655 A1 Sep. 4, 2008

(51) Int. Cl.
*A63B 47/04* (2006.01)

(52) U.S. Cl. ..... 15/244.1; 15/21.2; 15/104.94; 15/210.1; 401/11

(58) Field of Classification Search ..... 15/21.2, 15/104.92–104.94, 210.1, 244.1; 401/9–11
See application file for complete search history.

(56) References Cited

U.S. PATENT DOCUMENTS 1,565,414 A * 12/1925 Byrne ..... 15/244.1
1,710,816 A * 4/1929 Evans ..... 15/104.92
3,453,675 A * 7/1969 Barton et al. ..... 15/104.92
3,750,219 A * 8/1973 MacConnell ..... 15/118
4,411,040 A * 10/1983 Sharrow et al. ..... 15/104.94
5,004,239 A * 4/1991 Wettstein ..... 473/282
5,641,232 A * 6/1997 Frey ..... 401/11
6,036,386 A * 3/2000 McDonald ..... 401/10

FOREIGN PATENT DOCUMENTS

| | | |
|---|---|---|
| GB | 2120948 | * 12/1983 |
| JP | 02-239489 | 9/1990 |
| JP | 09-024118 | 1/1997 |
| JP | 2001-170218 | 6/2001 |
| JP | 2003-245379 | 9/2003 |

* cited by examiner

*Primary Examiner*—Mark Spisich
(74) *Attorney, Agent, or Firm*—Browdy and Neimark, P.L.L.C.

(57) ABSTRACT

The present invention relates to a portable golf ball cleaner to wipe off dirt attached to a surface of a golf ball during playing of golf. The golf ball cleaner comprises a cleaner body including a concave portion having a curved surface, a wipe-off part formed on an inner wall surface of the concave portion, and a lid to open and close the concave portion of the cleaner body. Because the golf ball cleaner can be easily carried by a golf player, by putting it in a pocket or hanging it from the waist, and the player is capable of rotating the golf ball in the concave portion having the curved surface while securely holding the golf bail by hand, the dirt attached to the surface of the golf ball can be thoroughly wiped off by the wipe-off part.

8 Claims, 8 Drawing Sheets

GOLF BALL CLEANER

TECHNICAL FIELD

The present invention relates to a portable golf ball cleaner to wipe off dirt attached to a surface of a golf ball during playing of golf.

BACKGROUND ART

A conventional golf ball cleaner of this kind is described in Patent Document 1. The golf ball cleaner 1 is formed by sewing synthetic leather or the like in the form of a bag-like body, as shown in FIG. 11. The bag-like body has at its upper end an opening 2 to allow insertion and removal of the golf ball and at its inner wall surface a cleaning part 3. The cleaning part 3 is formed by an aqueous material such as a fabric cloth, a non-woven cloth, a knitted fabric, sponge or the like and is used by prior impregnation with water and a little cleaning material. When using, a player inserts a dirt ball 4 in the bag-like body through the opening 2, holds an outer side of the bag-like body with one hand and grips the golf ball 4 from the outside of the bag-like body with the other hand, then moves both hands relatively, thereby cleaning the dirt attached to the surface of the golf ball 4 through wiping of the surface of the golf ball 4 by the cleaning part 3. After the wipe off is completed, the opening 2 of the golf ball cleaner 1 is closed, the golf ball cleaner is put in a pants pocket and playing of golf is restarted.

However, because the above-mentioned conventional golf ball cleaner 1 is small, only allowing for insertion of one golf ball 4 in the bag-like body, it is difficult to grip the inserted golf ball 4 with one hand, and hence the golf ball cannot be rotated in the bag-like body. In addition, because the bag-like body does not maintain a constant shape, or the like, even if the golf ball and the bag-like body are moved relatively, there is a problem that the surface of the golf ball 4 is not thoroughly wiped.

Patent Document: Japanese Patent Laid-Open No. 170218

DISCLOSURE OF INVENTION

Problems to be Resolved by the Invention

Problems to be resolved by the present invention are the difficulty of rotating a golf ball and the insufficient removal of dirt attached to a surface of a golf ball when carrying out the wiping off operation.

Means for Resolving the Problems

A golf ball cleaner according to the present invention has a main feature that a wipe-off part is provided on an inner wall surface of a concave portion having a curved surface which allows the golf ball to be sufficiently rotated to avoid leaving a portion of a surface of the golf ball insufficiently wiped.

In addition, the golf ball cleaner of the present invention is characterized by including a cleaner body provided with a concave portion having a curved surface and a lid to open and close the concave portion of the cleaner body which avoids getting the player's clothes wet.

EFFECT OF THE INVENTION

In the golf ball cleaner according to the present invention, because the wipe-off part is formed on the inner wall surface of the concave portion having the curved surface, a player can grip the golf ball securely with one hand and rotate the golf ball continuously on the wipe-off part to clean the surface of the golf ball without leaving any unwiped portion on the golf ball. Consequently, dirt attached to the surface of the golf ball can be thoroughly wiped off.

In addition, in the golf ball cleaner according to the present invention, because the concave portion of the cleaner body can be opened and closed by the lid, water contained in the wipe-off part does not leak to the outside. Therefore, even if a player carries the golf ball cleaner by putting it in a pocket or hanging it from the waist, it will not result in the player's clothes getting wet.

BEST MODE FOR CARRYING OUT THE INVENTION

Figure 1:
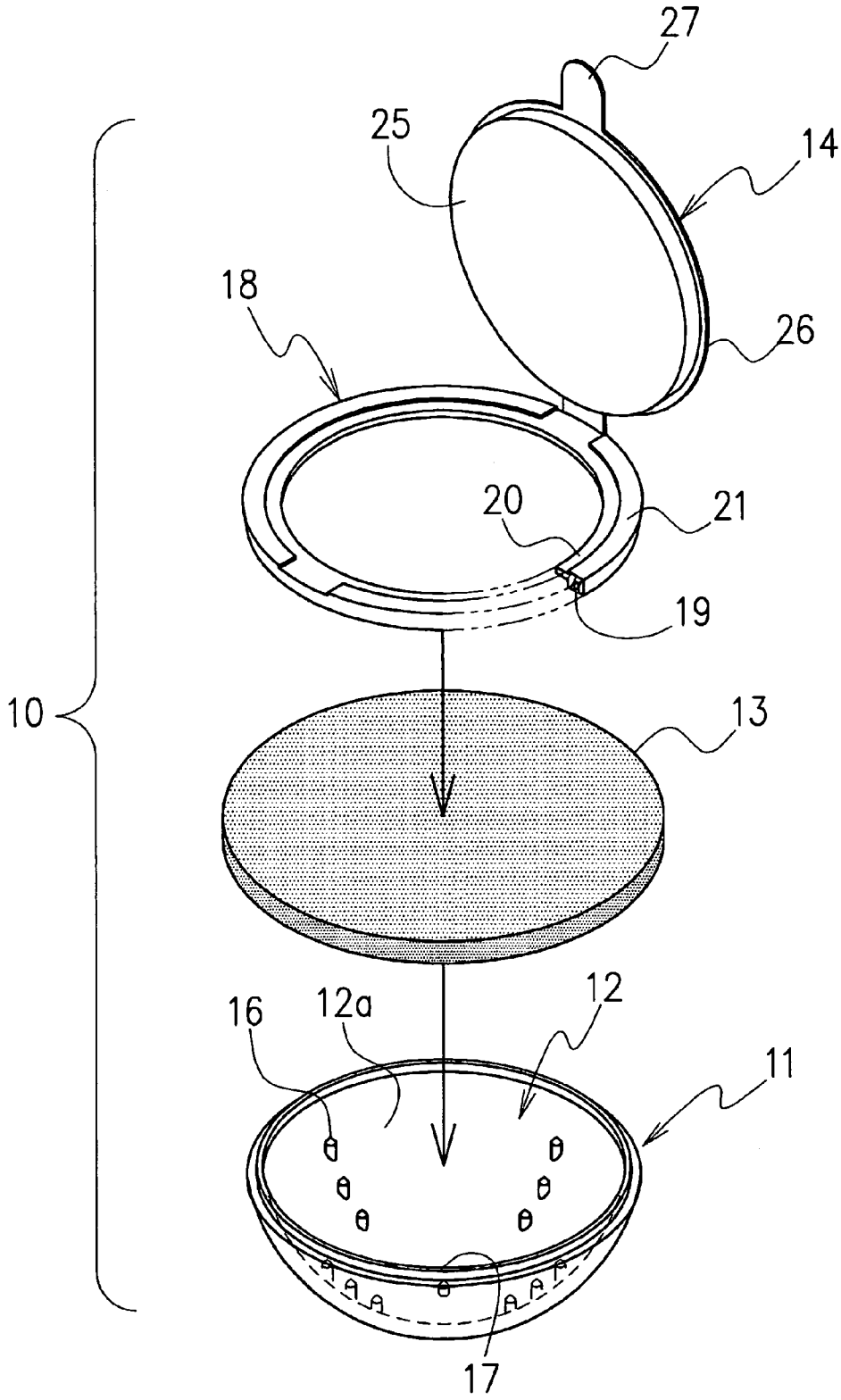
FIG. 1 is an exploded perspective view showing the entire structure of a golf ball cleaner according to a first embodiment of the present invention.
Figure 2:
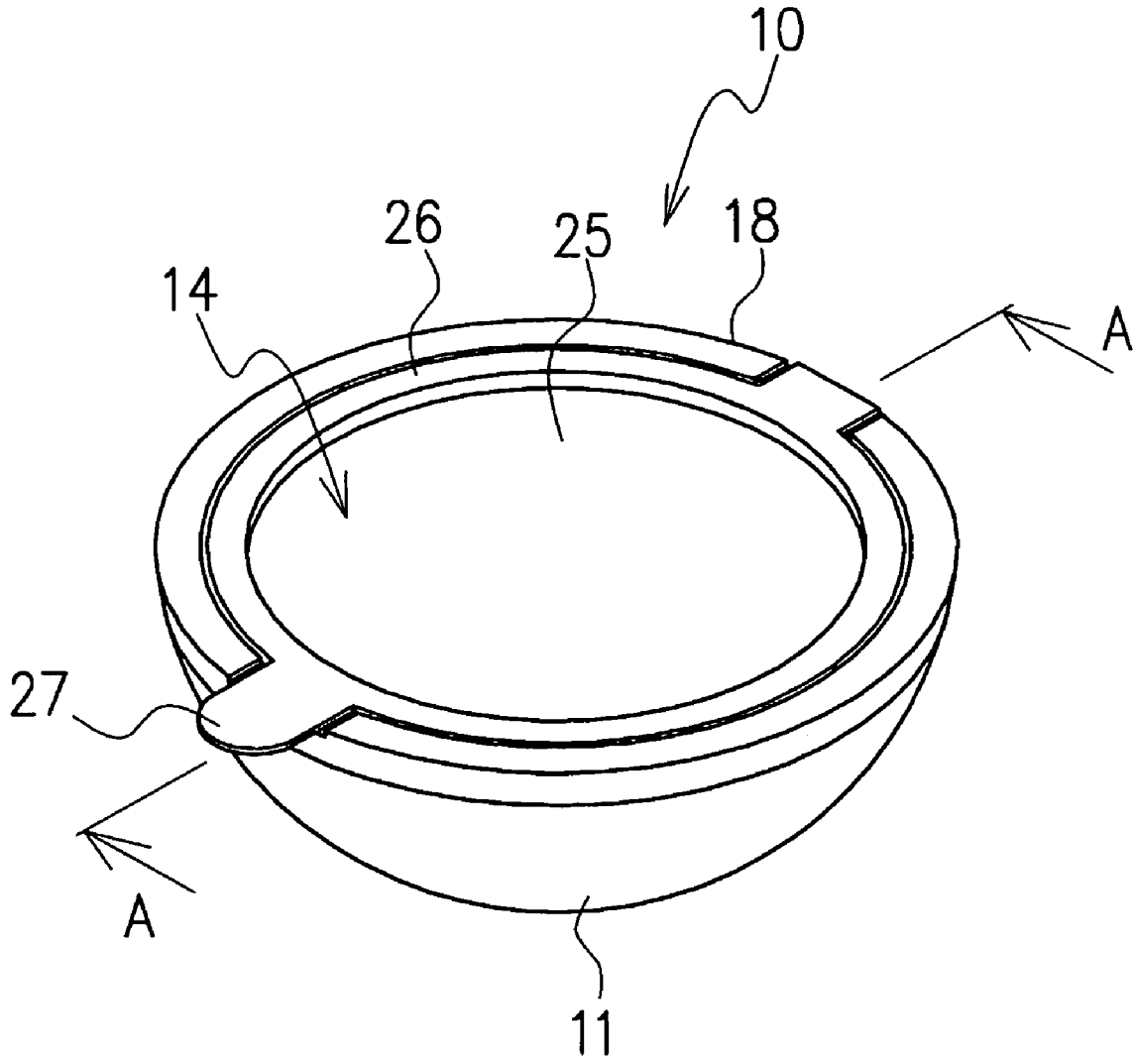
FIG. 2 is a perspective view of the golf ball cleaner when a lid is in a closed state.
Figure 3:
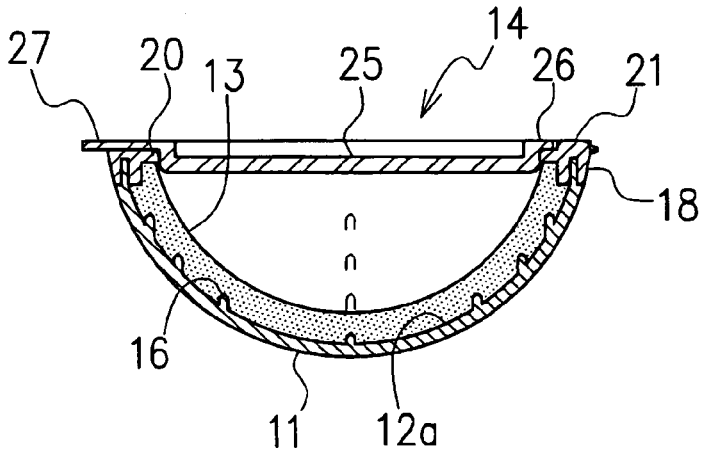
FIG. 3 is a sectional view taken along the A-A line in FIG. 2.
Figure 4:
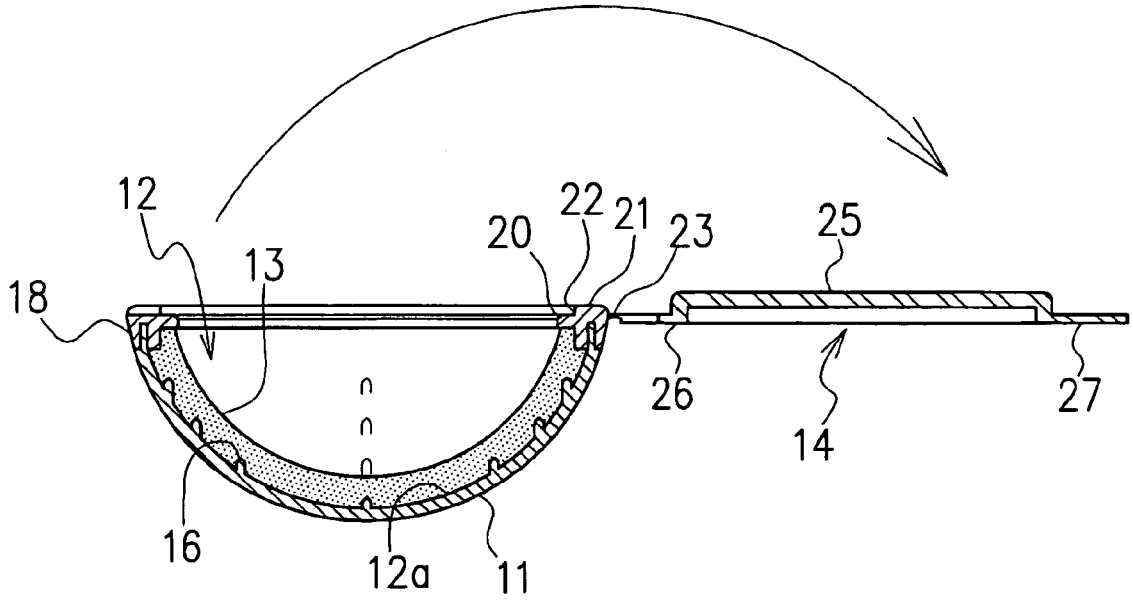
FIG. 4 is a sectional view of the golf ball cleaner when the lid is opened.
Figure 5:
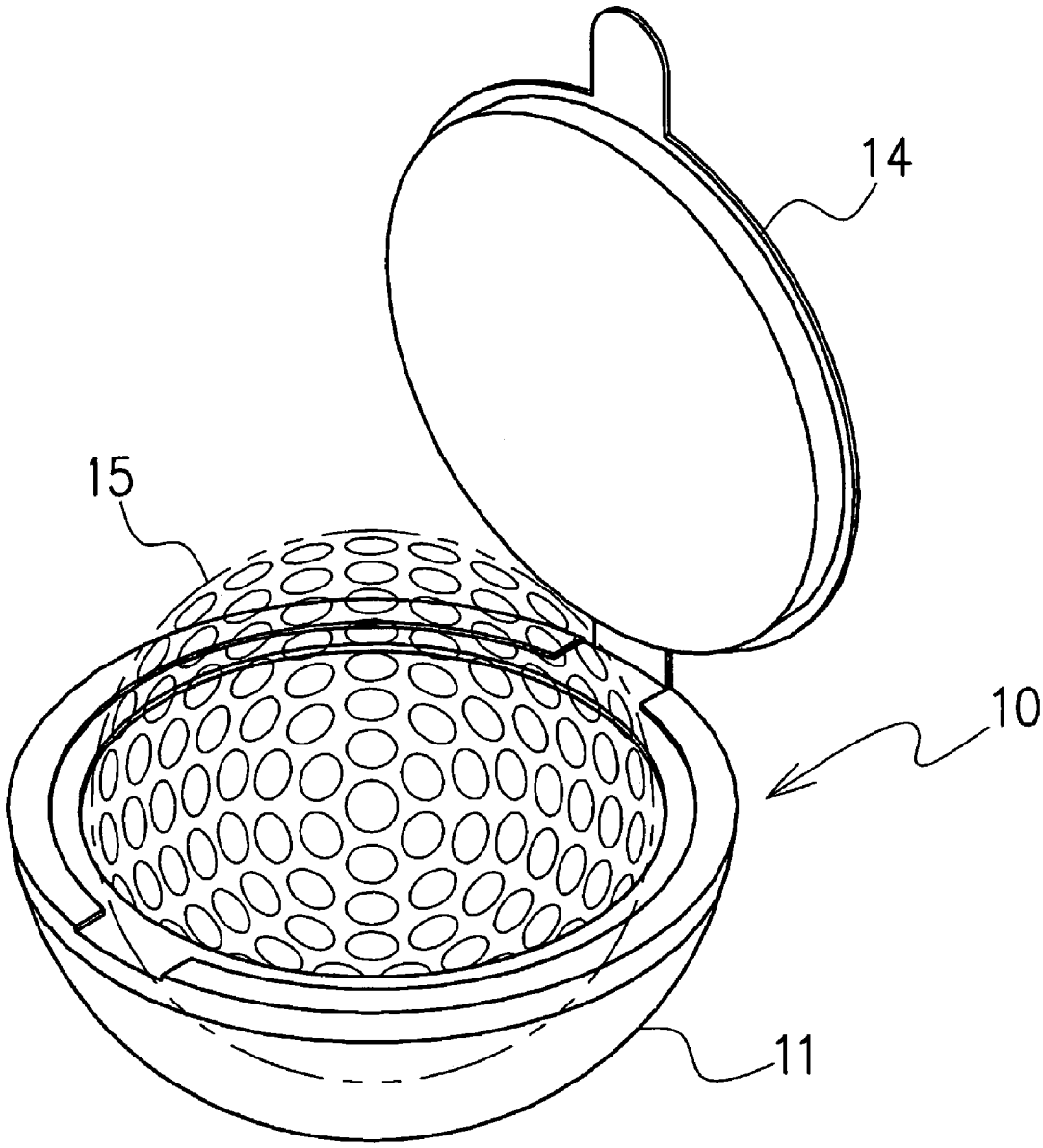
FIG. 5 is a perspective view of the golf ball cleaner when a golf ball is inserted in a concave portion.

Preferred embodiments of a golf ball cleaner according to the present invention will be explained with reference to the accompanying drawings below.

FIGS. 1 to 8 illustrate a structure of and mode of use of a golf ball cleaner 10 according to a first embodiment of the present invention. The golf ball cleaner 10 includes a semi-spherical cleaner body 11 formed by a resin, a wipe-off part 13 provided in a concave portion 12 of the cleaner body 11 and a lid 14 configured to open and close the concave portion 12 of the cleaner body 11.

Figure 6:
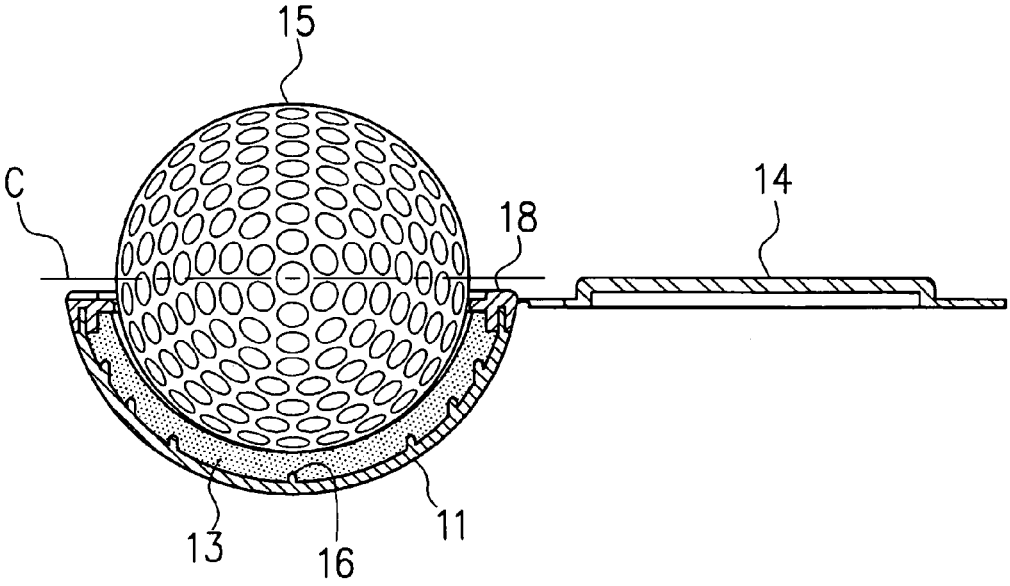
FIG. 6 is a sectional view of the golf ball cleaner when the golf ball is inserted in the concave portion.

The cleaner body 11 has a semi-spherical external shape which generally corresponds to a shape of a curved surface of a golf ball and is formed to be slightly larger than the golf ball. Moreover, a concave portion 12 having a curved surface which generally corresponds to the curved surface of the golf ball is formed on an inner side of the cleaner body 11. The curved surface of the concave portion 12 has a curvature radius slightly larger than that of the curved surface of the golf ball. For example, as shown in FIG. 6, when the golf ball 15 is inserted on the wipe-off part 13 provided on an inner wall surface 12*a* of the concave portion 12, it is preferable that slight clearances are formed at opposite sides of the golf ball 15.

It is also preferable that a depth of the concave portion 12 is set to be generally the same size as a radius of the golf ball 15 or of a size such that a center line C of the golf ball 15 protrudes slightly from the concave portion 12, in other words, more than half of the golf ball 15 protrudes from the concave portion 12, because the golf ball can be securely gripped allowing the golf ball 15 to be easily rotated.

A plurality of small protrusions 16 are provided on the inner wall surface 12*a* of the concave portion 12. Thirteen protrusions 16 may, for example, be arranged crosswise on the inner wall surface 12*a* of the concave portion 12, with one protrusion disposed on a center of a bottom of the concave portion 12 and twelve protrusions three each disposed at equal intervals in four directions from the one protrusion.

The wipe-off part 13 provided on the inner wall surface 12*a* of the concave portion 12 is used to wipe off dirt attached to a surface of the golf ball 15. The wipe-off part 13 is formed by, for example, a disc-shaped sponge body as shown in FIG. 1. The wipe-off part 13 is structured so that the sponge body is pressed to and in close contact with the inner wall surface 12*a* of the concave portion 12. The plurality of protrusions 16 projecting from the inner wall surface 12*a* of the concave portion 12 engage with a bottom surface of the wipe-off part 13 disposed to cover the entire inner wall surface 12*a*. Engagement of the wipe-off part 13 with the protrusions 16 in this way prevents the wipe-off part 13 from being rotated together with the golf ball 15 in the concave portion 12.

Not only a natural sea sponge but also synthetic resin or the like can be used as the sponge body. A thickness or resilience of the sponge body is also suitably selected. Furthermore, when using, it is desirable to soak the sponge body with a suitable amount of water.

Of course, the wipe-off part 13 according to the present invention is not limited to the sponge body, and application may be made of any substance or hydroscopic material which wipes off dirt on making contact with the surface of the golf ball 15. In addition, if the inner wall surface 12*a* of the concave portion 12 is made of such an above-mentioned material, the inner wall surface 12*a* may act directly as the wipe-off part 13.

The lid 14 to open and close the concave portion 12 of the cleaner body 11 is provided integrally with a purfle or annular rim member 18 attached to an edge 17 of an opening of the cleaner body 11. The purfle 18 includes a downwardly directed engaging groove 19 in which the opening edge 17 of the cleaner body 11 is fitted and an inwardly extending stopper wall 20 configured to hold down press an upper end portion of the wipe-off part 13 to prevent the wipe-off part 13 from becoming detached. The engaging groove and the stopper wall are provided throughout the entire periphery of the opening edge 17. A step 22 is provided between the stopper wall 20 and an upper surface 21 of the purfle 18 throughout the entire periphery of the opening edge 17, and when the concave portion 12 is closed by the lid 14, an outer peripheral edge of the lid 14 is fitted in the step 22.

The lid 14 is connected to one end of the purfle 18 of the cleaner body 11 by a resinous hinge 23 formed integrally with the purfle 18. A shape of the lid 14 corresponds to that of the opening of the cleaner body 11 and includes a circular flat plate-shaped cover 25 to close the concave portion 12, a flange 26 formed with a step on an outer periphery of the cover 25 and a tongue 27 which is disposed opposite to the resinous hinge 23 and extends horizontally outwards from the flange 26.

When opening and closing the lid with the tongue 27 gripped by fingers, the lid 14 is rotated about the resinous hinge 23. The concave portion 12 of the cleaner body 11 can be securely closed by the lid 14 by moving the lid 14 to cover the purfle 18 attached to the opening edge of the concave portion 12, laying the flange 26 on the upper surface of the stopper wall 20 and fitting an outer peripheral edge of the cover 25 to an inner peripheral edge of the stopper wall 20.

Next is an explanation of how to use the golf ball cleaner 10 having the above-mentioned structure.

Figure 7:
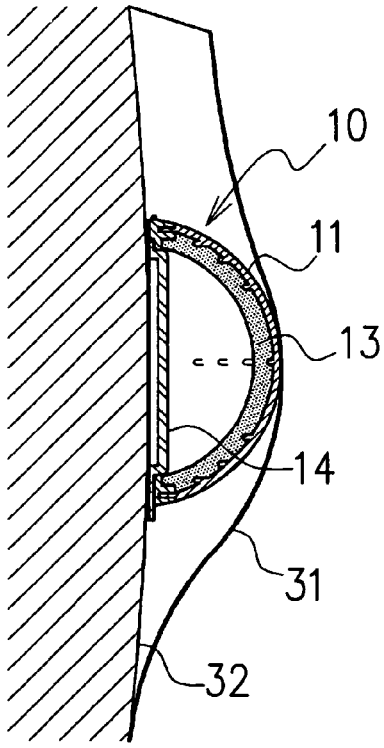
FIG. 7 is an explanatory view showing a state where the golf ball cleaner is contained in a pants pocket.

Before use, the sponge body constituting the wipe-off part 13 is first impregnated with sufficient water. A golf player can carry the golf ball cleaner 10 by putting it in a pants pocket 31, hanging it by a hanger (not shown) attached to the cleaner body 11 from the waist, or the like, as shown in FIG. 7. Because the concave portion 12 of the cleaner body 11 is securely closed by the lid 14, the wipe-off part 13 does not come into contact with the cloth in the pocket 31, and the pocket 31 does not get wet. In addition, as shown in FIG. 7, when the golf ball cleaner is inserted with the flat lid 14 directed to an inner side of the pants pocket 31, there is no uncomfortable feeling of any kind if the golf ball cleaner makes contact with the femoral region 32. Even if, on the contrary, a spherical surface portion of the cleaner body 11 makes contact with the femoral region 32, because the spherical surface portion has generally the same curved surface as the golf ball 15, the golf player can play without feeling discomfort.

Figure 8:
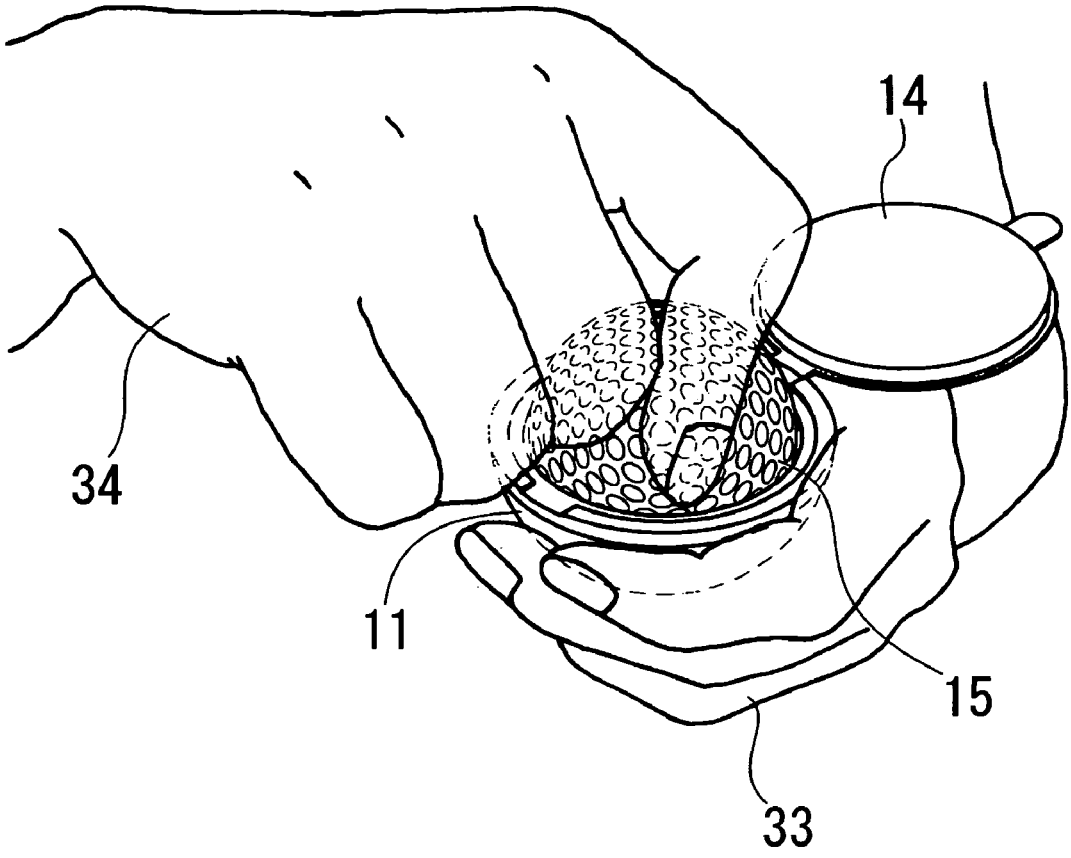
FIG. 8 is a perspective view showing a state of the golf ball cleaner in use.

The golf ball cleaner 10 according to the present invention is used with great frequency, in particular, when the golf ball 15 is on the green. If the player's golf ball on the green is dirty, the player first takes out the golf ball cleaner 10 from the player's pocket 31, grips the cleaner body 11 with the left hand 33 wrapping it around the cleaner body as shown in FIG. 8 and opens the lid 14 by pulling the tongue 27 up. The golf player then inserts the dirty golf ball 15 in the concave portion 12 of the cleaner body 11, grips the, golf ball 15 securely by, for example, using the three fingers of thumb, forefinger and mid finger of the right hand 34, rotates the golf ball while pressing it to the wipe-off part 13 wiping the entire surface of the golf ball 15, thereby thoroughly removing the dirt attached to the surface of the golf ball.

Because the sponge body as the wipe-off part 13 is engaged with the protrusions 16 projecting from the inner wall surface 12*a* of the concave portion 12 and the upper end portion of the sponge body is held down by the stopper wall 20 of the purfle 18, the wipe-off part 13 does not rotate together with the golf ball 15 even if the golf ball is rotated while pressing it to the wipe-off part 13. Therefore, continuous rotation of the golf ball on the wipe-off part 13 can be used to wipe the surface of the golf ball, and a sufficient wipe-off effect can be achieved. In this way, when the entire surface of the golf ball 15 has been thoroughly wiped, the concave portion 12 of the cleaner body 11 is closed by the lid 14 and the golf ball cleaner is then inserted in the pants pocket 31. The cleaned golf ball 15 is returned to its playing position and play is restarted.

As mentioned above, because the external shape of the cleaner body 11 has the same spherical shape as the golf ball 15, the player can grip the cleaner body wrapping one hand around it, thus making it easy to grip and securely support the cleaner body with one hand, when wiping the golf ball. Moreover, because the curved surface of the concave portion 12 corresponds to the outer curved surface of the golf ball 15, it is easy to rotate the golf ball 15. Therefore, the player can rotate the golf ball 15 on the wipe-off part 13 continuously, and avoid leaving any parts of the surface of the golf ball 15 insufficiently wiped.

Figure 9:
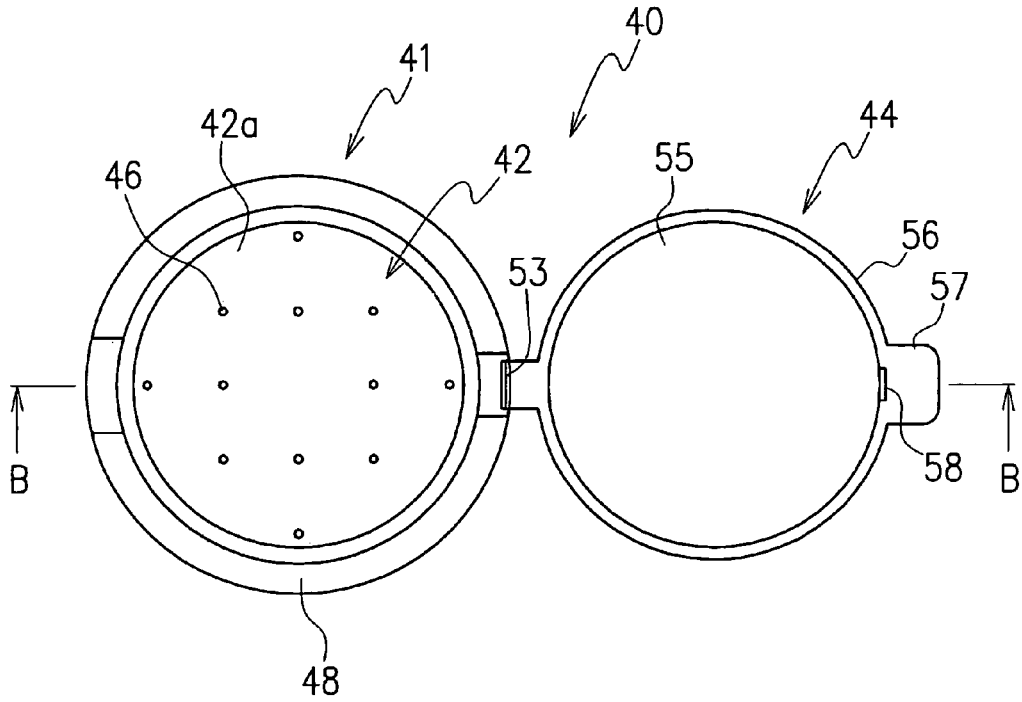
FIG. 9 is a plan view showing a golf ball cleaner according to a second embodiment of the present invention.
Figure 10:
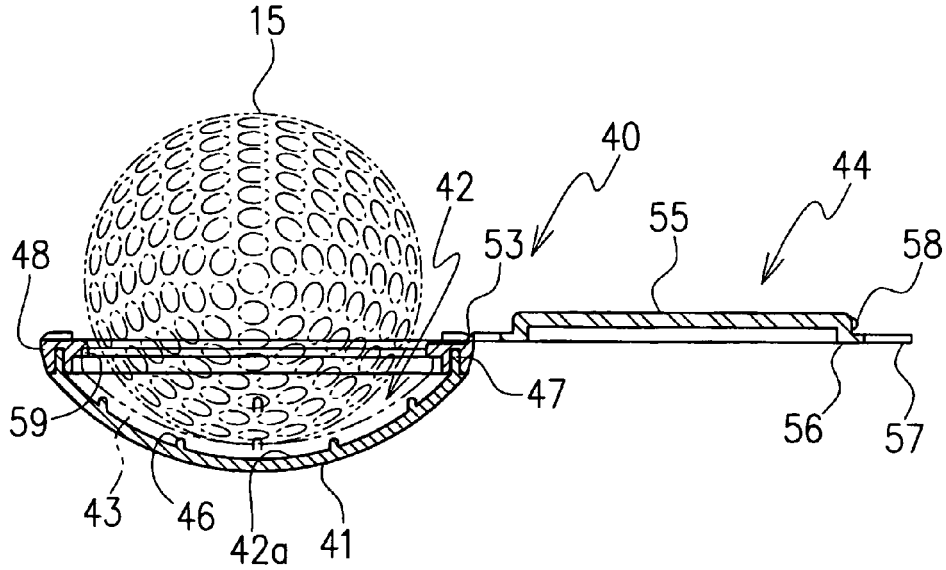
FIG. 10 is a sectional view taken along the B-B line in FIG. 9.
Figure 11:
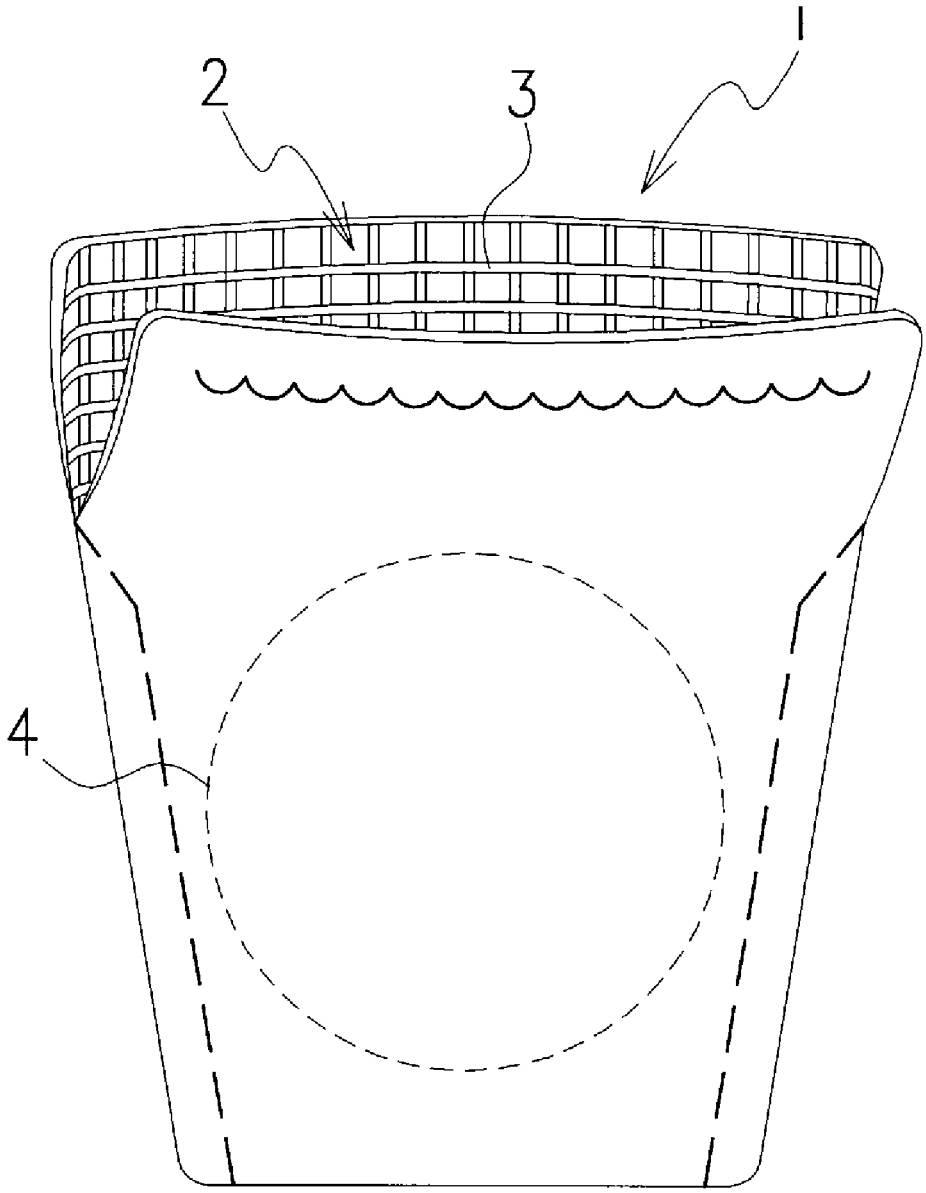
Fig. 11 (Prior Art)
FIG. 11 is an exploded perspective view showing one example of a conventional golf ball cleaner.

FIGS. 9 and 10 illustrate a second embodiment of the golf ball cleaner according to the present invention.

The golf ball cleaner 40 in this embodiment is structured from a cleaner body 41 and a lid 44, similarly to the first embodiment, but differs from the first embodiment in that a concave portion 42 of the cleaner body 41 has a depth which is less than that in the first embodiment. That is to say, the curved surface of the concave portion 42 is set to have a curvature radius larger than that of the concave portion 12 in the first embodiment, and the concave portion 42 has a gradually curved shape. It is therefore even easier to rotate and wipe the golf ball 15. Meanwhile, a plurality of small protrusions 46 engaging with a wipe-off part 43 formed by a sponge body or the like are provided on an inner wall surface 42*a* of the concave portion 42, but an arrangement of the protrusions 46 differs from that of the protrusions 16 in the first embodiment.

On the other hand, the lid 44 is configured to be formed integrally with a purfle 48 attached to an opening edge of the cleaner body 41 through a resinous hinge 53, similarly to the first embodiment. Moreover, the lid 44 is structured from a circular flat plate-shaped cover 55 to close the concave portion 42 of the cleaner body 41, a flange 56 formed with a step on an outer periphery of the cover 55 and a tongue 57 extending horizontally outward from the flange 56, but differing from the first embodiment, in that an engaging pawl 58 is provided to project from a vertical wall of the flange 56 in the vicinity of the tongue 57. The lid 44 can be prevented from incomplete closure by engaging the engaging pawl 58 with an engaging groove 59 formed in the purfle 48.

In the golf ball cleaner according to the present invention, a shape of the cleaner body is, of course, not limited to that shown in the first embodiment. Basically, if the cleaner body includes a concave portion having a curved surface which makes it easy to wipe the surface of the golf ball, a size, shape, depth or the like of the concave portion are not limited to those as mentioned above.

INDUSTRIAL APPLICABILITY

Recently there has been a great increase in the proportion of golf courses where players carry their own clubs and other equipment. In such a cases, because the golf ball cleaner according to the present invention can be carried by a player and the player can take out the golf ball cleaner and use it, the golf ball cleaner is very convenient for the player and has good usability. When using the golf ball cleaner, the player grips the cleaner body with one hand and the golf ball with the other hand, and merely rotates the golf ball in the concave portion, thereby enabling easy removal of dirt or the like attached to the surface of the golf ball.

DESCRIPTION OF REFERENCE NUMBERS

10 golf ball cleaner
11 cleaner body
12 concave portion
12*a* inner wall surface
13 wipe-off part (sponge body)
14 lid
15 golf ball
16 protrusions
23 resinous hinge

The invention claimed is:

1. A golf ball cleaner, comprising:

a cleaner body including a concave portion having a curved inner wall surface and a wipe-off member disposed along the curved inner wall surface of the concave portion when a golf ball is not inserted in the concave portion, a wipe-off surface of the wipe-off member being curved;

a lid to open and close the concave portion of the cleaner body; and an annular rim member attached to an opening edge of the cleaner body and provided integrally with the lid at a peripheral edge portion thereof, and a stopper wall provided on the annular rim member and configured to be in contact with an upper portion of the member and prevent the wipe-off member from being uplifted.

2. The golf ball cleaner according to claim 1, wherein the concave portion includes a curved surface which substantially corresponds to a curved surface of a golf ball or a curved surface having a curvature radius larger than the curved surface of the golf ball.

3. The golf ball cleaner according to claim 1, the concave portion has a depth of the same size as a radius of a golf ball or a depth of a size lesser than the radius of the golf ball.

4. The golf ball cleaner according to claim 1, wherein an external form of the cleaner body is of a curved surface-like shape.

5. The golf ball cleaner according to claim 1, wherein the wipe-off member is formed by a sponge body laid along the inner wall surface of the concave portion.

6. The golf ball cleaner according to claim 5, wherein the inner wall surface of the concave portion includes protrusions provided to engage with the sponge body to prevent movement of the sponge body when the golf ball is inserted in the golf ball cleaner.

7. The golf ball cleaner according to claim 1, wherein the lid is connected to the annular rim member through a resinous hinge.

8. The golf ball cleaner according to claim 1, wherein the inner wall surface of the concave portion includes protrusions provided to engage with the wipe-off member to prevent movement of the wipe-off member when the golf ball is inserted in the golf ball cleaner.

* * * * *